US010415317B2

(12) United States Patent
Bomidi et al.

(10) Patent No.: US 10,415,317 B2
(45) Date of Patent: Sep. 17, 2019

(54) CUTTING ELEMENT ASSEMBLIES COMPRISING ROTATABLE CUTTING ELEMENTS AND EARTH-BORING TOOLS COMPRISING SUCH CUTTING ELEMENT ASSEMBLIES

(71) Applicant: Baker Hughes, LLC, Houston, TX (US)

(72) Inventors: John Abhishek Raj Bomidi, Spring, TX (US); Alexander Rodney Boehm, Wheat Ridge, CO (US); Kegan L. Lovelace, Houston, TX (US); William A. Moss, Jr., Conroe, TX (US); Jon David Schroder, The Woodlands, TX (US)

(73) Assignee: Baker Hughes, LLC, Houston, TX (US)

( * ) Notice: Subject to any disclaimer, the term of this patent is extended or adjusted under 35 U.S.C. 154(b) by 127 days.

(21) Appl. No.: 15/662,723

(22) Filed: Jul. 28, 2017

(65) Prior Publication Data

US 2019/0032407 A1 Jan. 31, 2019

(51) Int. Cl.

| | |
|---|---|
| ***E21B 10/22*** | (2006.01) |
| ***E21B 10/32*** | (2006.01) |
| ***E21B 10/46*** | (2006.01) |

(52) U.S. Cl.

CPC ..... *E21B 10/22* (2013.01); *E21B 10/325* (2013.01); *E21B 10/46* (2013.01)

(58) Field of Classification Search

CPC ..... E21B 10/22
USPC ..... 175/371
See application file for complete search history.

(56) References Cited

U.S. PATENT DOCUMENTS

| | | | |
|---|---|---|---|
| 4,553,615 | A | 11/1985 | Grainger |
| 4,751,972 | A | 6/1988 | Jones et al. |
| 7,604,073 | B2 | 10/2009 | Cooley et al. |
| 7,703,559 | B2 | 4/2010 | Shen et al. |

(Continued)

FOREIGN PATENT DOCUMENTS

| | | | |
|---|---|---|---|
| WO | 2016/081807 | A1 | 5/2016 |

OTHER PUBLICATIONS

International Written Opinion for International Application No. PCT/US2018/043375 dated Oct. 19, 2018, 8 pages.

(Continued)

*Primary Examiner* — Taras P Bemko
(74) *Attorney, Agent, or Firm* — TraskBritt

(57) ABSTRACT

An earth-boring tool comprising a bit-body, a blade, and a cutting element assembly. The cutting element assembly comprising a journal, a rotatable cutting element, and a retention element. The journal defines an upper cylindrical exterior surface, a first bearing surface that intersects the upper cylindrical exterior surface, and a first external groove in the upper cylindrical exterior surface. The rotatable cutting element comprises a table of polycrystalline hard material having an end cutting surface and a supporting substrate. The substrate defines a second bearing surface, a longitudinally extending blind hole having a diameter larger than the diameter of the upper cylindrical exterior surface of the journal, and a second groove in the surface of the substrate defining the blind hole. The retention element is disposed at least partially in the first groove and partially within the second groove.

14 Claims, 6 Drawing Sheets

(56) References Cited

U.S. PATENT DOCUMENTS

| | | | |
|---|---|---|---|
| 7,762,359 | B1 | 7/2010 | Miess |
| 7,845,436 | B2 | 12/2010 | Cooley et al. |
| 7,987,931 | B2 | 8/2011 | Cooley et al. |
| 8,061,452 | B2 | 11/2011 | Cooley et al. |
| 8,079,431 | B1 | 12/2011 | Cooley et al. |
| 8,091,655 | B2 | 1/2012 | Shen et al. |
| 8,210,285 | B2 | 7/2012 | Cooley et al. |
| 8,413,746 | B2 | 4/2013 | Shen et al. |
| 8,561,728 | B2 | 10/2013 | Cooley et al. |
| 8,800,691 | B2 | 8/2014 | Shen et al. |
| 8,881,849 | B2 | 11/2014 | Shen et al. |
| 8,931,582 | B2 | 1/2015 | Cooley et al. |
| 8,950,516 | B2 | 2/2015 | Newman |
| 8,973,684 | B1 | 3/2015 | Cooley et al. |
| 8,991,523 | B2 | 3/2015 | Shen et al. |
| 9,016,409 | B2 | 4/2015 | Zhang et al. |
| 9,033,070 | B2 | 5/2015 | Shen et al. |
| 9,187,962 | B2 | 11/2015 | Burhan et al. |
| 9,279,294 | B1 | 3/2016 | Cooley et al. |
| 9,291,000 | B2 | 3/2016 | Zhang et al. |
| 9,322,219 | B2 | 4/2016 | Burhan et al. |
| 9,328,564 | B2 | 5/2016 | Zhang et al. |
| 9,382,762 | B2 | 7/2016 | Cooley et al. |
| 9,388,639 | B2 | 7/2016 | Patel et al. |
| 9,464,486 | B2 | 10/2016 | Zhang et al. |
| 2007/0278017 | A1* | 12/2007 | Shen ..... E21B 10/5673 175/426 |
| 2008/0017419 | A1* | 1/2008 | Cooley ..... B23B 27/12 175/286 |
| 2008/0251293 | A1 | 10/2008 | Mumma et al. |
| 2014/0054094 | A1* | 2/2014 | Burhan ..... E21B 10/50 175/354 |
| 2014/0131118 | A1 | 5/2014 | Chen et al. |
| 2014/0326515 | A1* | 11/2014 | Shi ..... E21B 10/46 175/365 |
| 2014/0326516 | A1* | 11/2014 | Haugvaldstad ..... E21B 10/567 175/366 |
| 2014/0360789 | A1 | 12/2014 | Siracki et al. |
| 2014/0360792 | A1 | 12/2014 | Azar et al. |
| 2015/0047910 | A1 | 2/2015 | Chen et al. |
| 2015/0330153 | A1 | 11/2015 | Miller et al. |
| 2016/0290056 | A1* | 10/2016 | Propes ..... E21B 10/43 |
| 2017/0191317 | A1* | 7/2017 | Burhan ..... E21B 10/50 |

OTHER PUBLICATIONS

International Search Report for International Application No. PCT/US2018/043375 dated Oct. 19, 2018, 3 pages.

* cited by examiner

CUTTING ELEMENT ASSEMBLIES COMPRISING ROTATABLE CUTTING ELEMENTS AND EARTH-BORING TOOLS COMPRISING SUCH CUTTING ELEMENT ASSEMBLIES

FIELD

Embodiments of the present disclosure relate generally to rotatable cutting elements and earth-boring tools having such cutting elements.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit, such as an earth-boring rotary drill bit. Different types of earth-boring rotary drill bits are known in the art, including fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may include, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated with or without drill string rotation.

A drill string may include a number of components in addition to a downhole motor and drill bit including, without limitation, drill pipe, drill collars, stabilizers, measuring while drilling (MWD) equipment, logging while drilling (LWD) equipment, downhole communication modules, and other components.

Cutting elements used in earth boring tools often include polycrystalline diamond compact (often referred to as "PDC") cutting elements, which are cutting elements that include so-called "tables" of a polycrystalline diamond material mounted to supporting substrates and presenting a cutting face for engaging a subterranean formation. Polycrystalline diamond (often referred to as "PCD") material is material that includes inter-bonded grains or crystals of diamond material. In other words, PCD material includes direct, intergranular bonds between the grains or crystals of diamond material.

Cutting elements are typically mounted on the body of a drill bit by brazing. The drill bit body is formed with recesses therein, commonly termed "pockets," for receiving a substantial portion of each cutting element in a manner which presents the PCD layer at an appropriate back rake and side rake angle, facing in the direction of intended bit rotation, for cutting in accordance with the drill bit design. In such cases, a brazing compound is applied between the surface of the substrate of the cutting element and the surface of the recess on the bit body in which the cutting element is received. The cutting elements are installed in their respective recesses in the bit body, and heat is applied to each cutting clement to raise the temperature to a point high enough to braze the cutting elements to the bit body in a fixed position but not so high as to damage the PCD layer.

Unfortunately, securing a PDC cutting element to a drill bit restricts the useful life of such cutting element, as the cutting edge of the diamond table wears down as does the substrate, creating a so-called "wear flat" and necessitating increased weight on bit to maintain a given rate of penetration of the drill bit into the formation due to the increased surface area presented. In addition, unless the cutting element is heated to remove it from the bit and then rebrazed with an unworn portion of the cutting edge presented for engaging a formation, more than half of the cutting element is never used.

Rotatable cutting elements mounted for rotation about a longitudinal axis of the cutting element can be made to rotate by mounting them at an angle in the plane in which the cutting elements are rotating (side rake angle). This will allow them to wear more evenly than fixed cutting elements, having a more uniform distribution of heat across and heat dissipation from the surface of the PDC table and exhibit a significantly longer useful life without removal from the drill bit. That is, as a cutting element rotates in a bit body, different parts of the cutting edges or surfaces of the PDC table may be exposed at different times, such that more of the cutting element is used. Thus, rotatable cutting elements may have a longer life than fixed cutting elements.

Additionally, rotatable cutting elements may mitigate the problem of "bit balling," which is the buildup of debris adjacent to the edge of the cutting face of the PDC table. As the PDC table rotates, the debris built up at the edge of the PDC table in contact with a subterranean formation may be forced away as the PDC table rotates.

BRIEF SUMMARY

A cutting element assembly includes a journal, a rotatable cutting element, and a retention element. The journal defines an upper cylindrical exterior surface and a first bearing surface, wherein the upper cylindrical exterior surface intersects the first bearing surface. The journal further defines a first external annular groove in the upper cylindrical exterior surface. The rotatable cutting element comprises a table of polycrystalline hard material having an end cutting surface and a supporting substrate. The substrate defines a second bearing surface, a longitudinally extending blind hole having a diameter larger than the diameter of the upper cylindrical exterior surface of the journal, and a second groove in a surface of the substrate that defines the blind hole. The retention element is disposed at least partially in the first groove and partially within the second groove.

Some embodiments include an earth-boring tool having a bit body, a blade, a journal, a rotatable cutting element, and a retention element. The earth-boring tool body has a blade extending radially outward defining a face proximate a leading end of the body. The journal is carried by a rotationally leading portion of the blade, and defines an upper cylindrical exterior surface and a first bearing surface, wherein the upper cylindrical exterior surface intersects the first bearing surface. The journal further defines a first external annular groove in the upper cylindrical exterior surface. The rotatable cutting element comprises a table of polycrystalline hard material having an end cutting surface and a supporting substrate. The substrate defines a second bearing surface, a longitudinally extending blind hole having a diameter larger than the diameter of the upper cylindrical exterior surface of the journal, and a second groove in the surface of the substrate that defines the blind hole. The retention element is disposed at least partially in the first groove and partially within the second groove.

DETAILED DESCRIPTION

Figure 1:
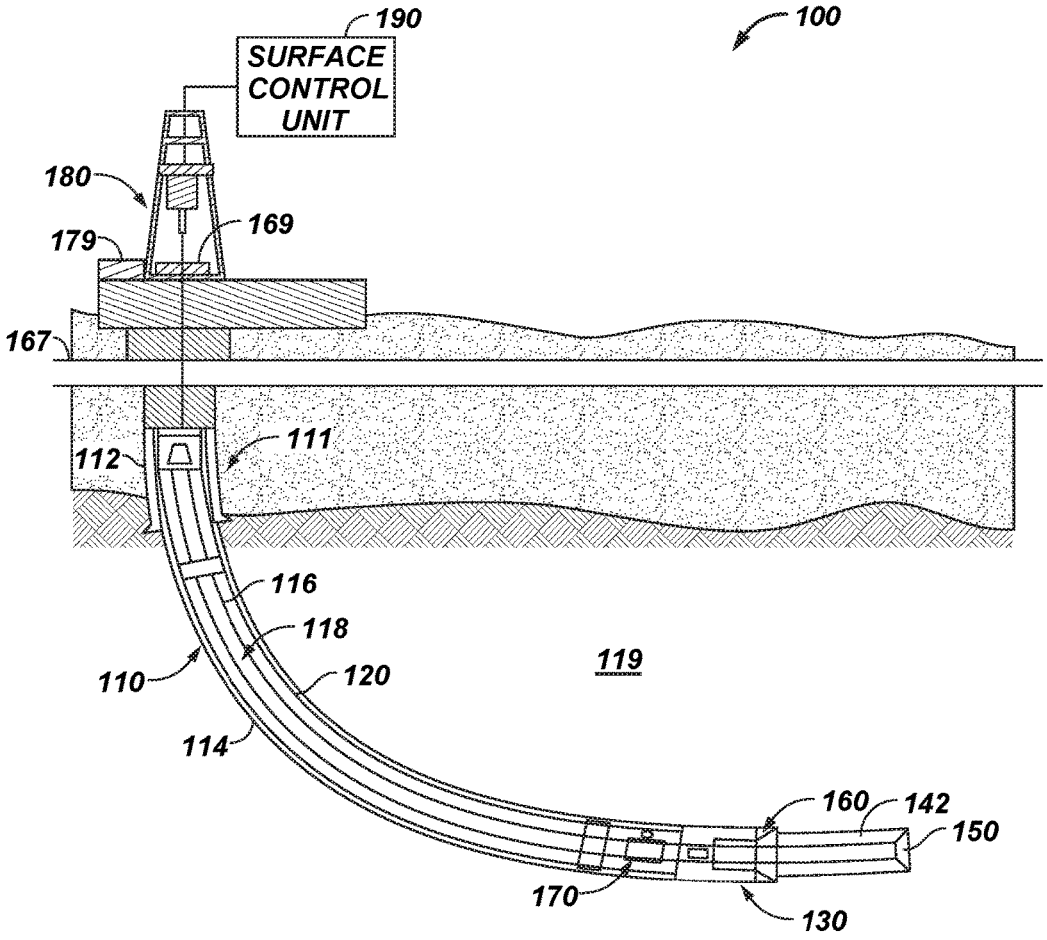
FIG. 1 is a simplified schematic diagram of an example of a drilling system using cutting element assemblies disclosed herein.

The illustrations presented herein are not actual views of any particular tool or drill string, but are merely idealized representations that are employed to describe example embodiments of the present disclosure. The following description provides specific details of embodiments of the present disclosure in order to provide a thorough description thereof. However, a person of ordinary skill in the art will understand that the embodiments of the disclosure may be practiced without employing many such specific details. Indeed, the embodiments of the disclosure may be practiced in conjunction with conventional techniques employed in the industry. In addition, the description provided below does not include all elements to form a complete structure or assembly. Only those process acts and structures necessary to understand the embodiments of the disclosure are described in detail below. Additional conventional acts and structures may be used. Also note, any drawings accompanying the application are for illustrative purposes only, and are thus not drawn to scale. Additionally, elements common between figures may retain the same numerical designation.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof.

As used herein, the term "may" with respect to a material, structure, feature or method act indicates that such is contemplated for use in implementation of an embodiment of the disclosure, and such term is used in preference to the more restrictive term "is" so as to avoid any implication that other, compatible materials, structures, features and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter).

As used herein, the term "hard material" means and includes any material having a Knoop hardness value of about 1,000 $Kg_f/mm^2$ (9,807 MPa) or more. Hard materials include, for example, diamond, cubic boron nitride, boron carbide, tungsten carbide, etc.

As used herein, the term "intergranular bond" means and includes any direct atomic bond (e.g., covalent, metallic, etc.) between atoms in adjacent grains of material.

As used herein, the term "polycrystalline hard material" means and includes any material comprising a plurality of grains or crystals of the material that are bonded directly together by intergranular bonds. The crystal structures of the individual grains of polycrystalline hard material may be randomly oriented in space within the polycrystalline hard material.

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

FIG. 1 is a schematic diagram of an example of a drilling system 100 using cutting element assemblies disclosed herein. FIG. 1 shows a wellbore 110 that includes an upper section 111 with a casing 112 installed therein and a lower section 114 that is being drilled with a drill string 118. The drill string 118 includes a tubular member 116 that carries a drilling assembly 130 at its bottom end. The tubular member 116 may be coiled tubing or may be formed by joining drill pipe sections. A drill bit 150 (also referred to as the "pilot bit") is attached to the bottom end of the drilling assembly 130 for drilling a first, smaller diameter borehole 142 in the formation 119. A reamer bit 160 may be placed above or up-hole of the pilot bit 150 in the drill string 118 to enlarge the smaller diameter borehole 142 to a second, larger diameter borehole 120. The terms wellbore and borehole are used herein as synonyms.

The drill string 118 extends to a rig 180 at the surface 167. The rig 180 shown is a land rig for ease of explanation. The apparatus and methods disclosed herein equally apply when an offshore rig is used for drilling underwater. A rotary table 169 or a top drive may rotate the drill string 118 and the drilling assembly 130, and thus the pilot bit 150 and reamer bit 160, to respectively drill boreholes 142 and 120. The rig 180 also includes conventional devices, such as mechanisms to add additional sections to the tubular member 116 as the wellbore 110 is drilled. A surface control unit 190, which may be a computer-based unit, is placed at the surface 167 for receiving and processing downhole data transmitted by the drilling assembly 130 and for controlling the operations of the various devices and sensors 170 in the drilling assembly 130. A drilling fluid from a source 179 thereof is pumped under pressure through the tubular member 116 that discharges at the bottom of the pilot bit 150 and returns to the surface 167 via the annular space (also referred to as the "annulus") between the drill string 118 and an inside wall of the wellbore 110.

During operation, when the drill string 118 is rotated, both the pilot bit 150 and the reamer bit 160 rotate. The pilot bit 150 drills the first, smaller diameter borehole 142, while simultaneously the reamer bit 160 enlarges the smaller diameter borehole 142 to a second, larger diameter borehole 120. The earth's subsurface may contain rock strata made up of different rock structures that can vary from soft formations to very hard formations, and therefore the pilot bit 150 and/or the reamer bit 160 may be selected based on the formations expected to be encountered in a drilling operation.

Figure 2:
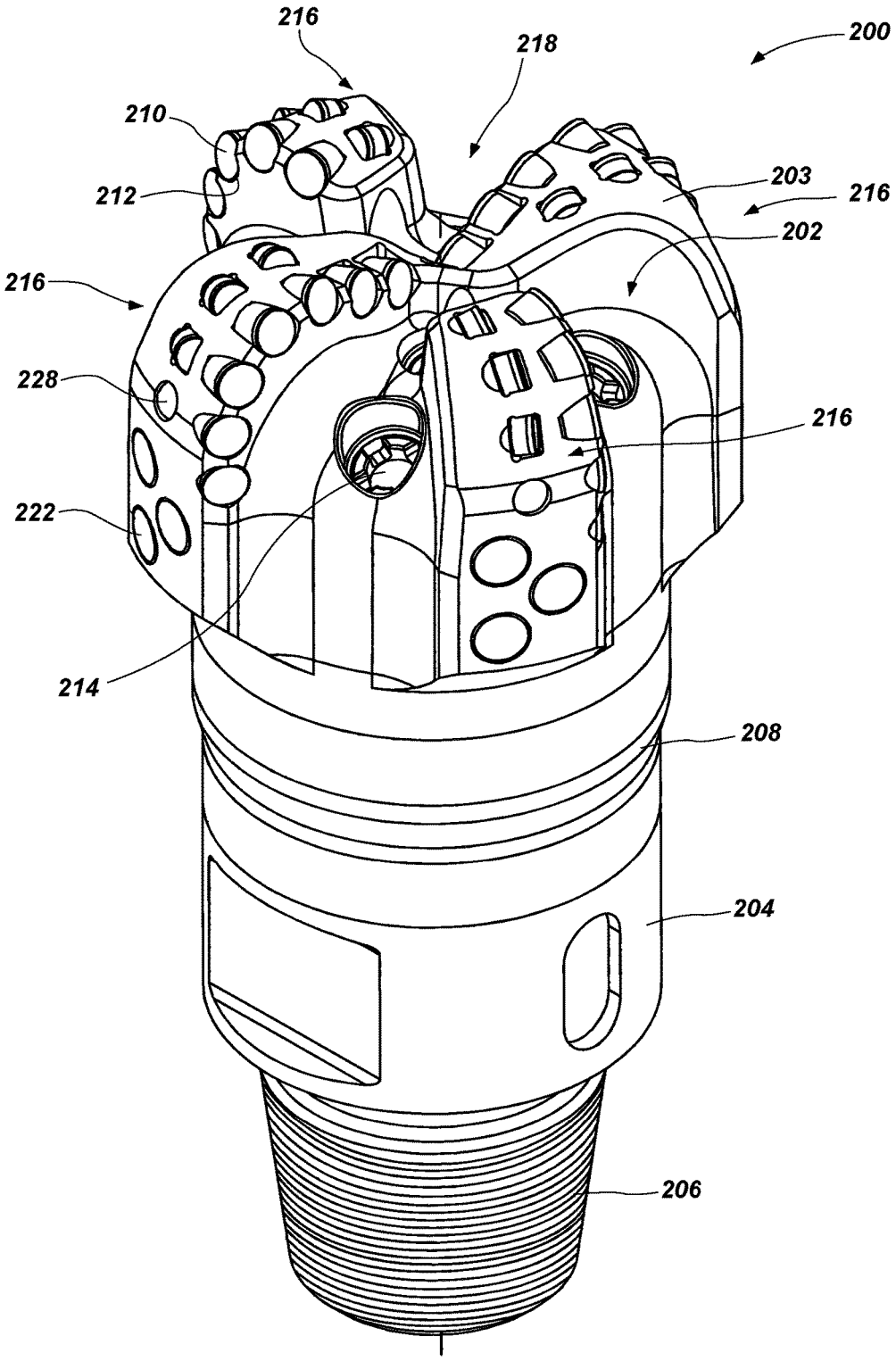
FIG. 2 is a simplified perspective view of a fixed-blade earth-boring rotary drill bit that may be used in conjunction with the drilling system of FIG. 1.

FIG. 2 is a perspective view of a fixed-cutter earth-boring rotary drill bit 200 that may be used in conjunction with the drilling system 100 of FIG. 1. For example, the drill bit 200 may be the pilot bit 150 shown in FIG. 1. The drill bit 200 includes a bit body 202 that may be secured to a shank 204 having a threaded connection portion 206 (e.g., an American Petroleum Institute (API) threaded connection portion) for attaching the drill bit 200 to a drill string (e.g., drill string 118, shown in FIG. 1). In some embodiments, the bit body 202 may be secured to the shank 204 using an extension 208. In other embodiments, the bit body 202 may be secured directly to the shank 204.

The bit body 202 may include internal fluid passageways that extend between the face 203 of the bit body 202 and a longitudinal bore, extending through the shank 204, the extension 208, and partially through the bit body 202. Nozzle inserts 214 also may be provided at the face 203 of the bit body 202 within the internal fluid passageways. The bit body 202 may further include a plurality of blades 216 that are separated by junk slots 218. In some embodiments, the bit body 202 may include gage wear plugs 222 and wear knots 228. A plurality of cutting element assemblies 210 may be mounted on the face 203 of the bit body 202 in cutting element pockets 212 that are located along each of the blades 216. The cutting element assemblies 210 may include PDC cutting elements, or may include other cutting elements. For example, some or all of the cutting element assemblies 210 may include rotatable cutters, as described below and shown in FIGS. 3-6.

Figure 3:
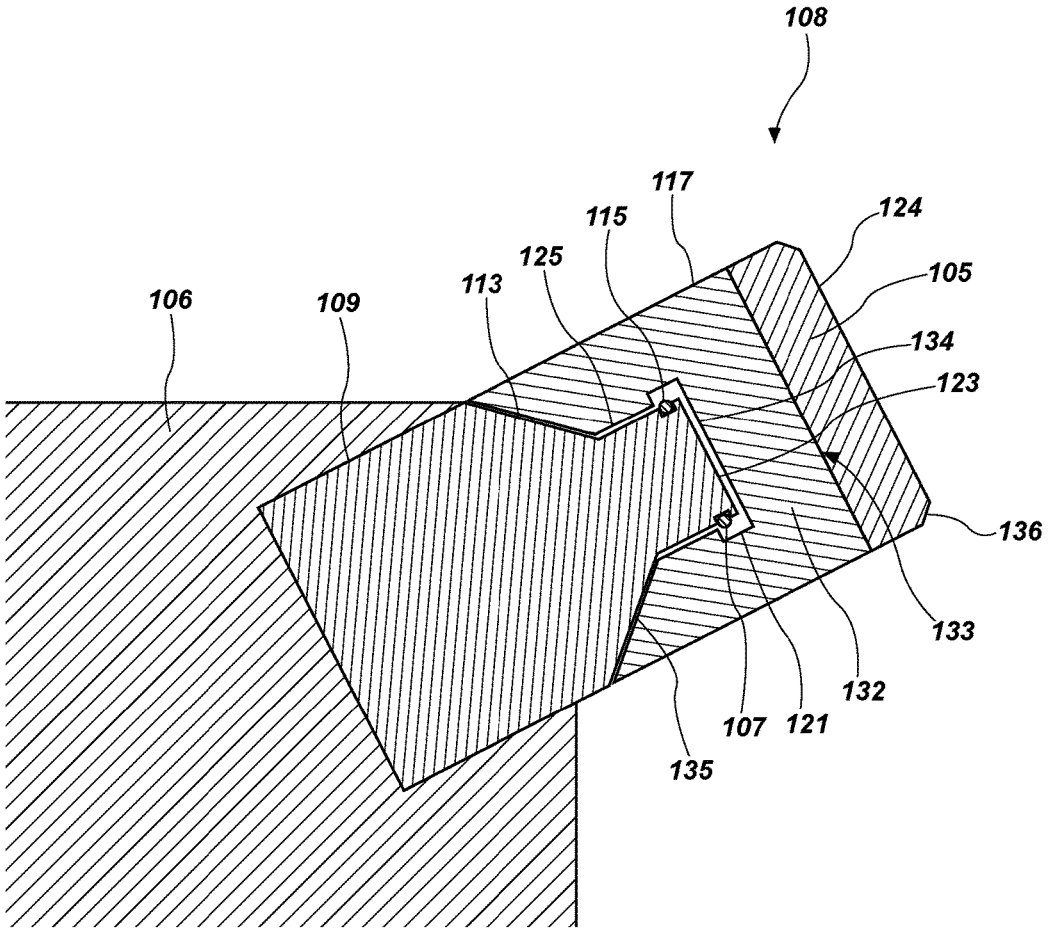
FIG. 3 is a simplified cross-sectional view of a rotatable cutting element assembly attached into a drill bit as shown in FIG. 2.

FIG. 3 is a simplified cross-section showing a cutting element assembly 108 mounted in a blade 106 of an earth boring tool. The blade 106 may be, for example, one of the blades 216 shown in FIG. 2. The cutting element assembly 108 may be one of the cutting element assemblies 210 shown in FIG. 2. The angle of the cutting element assembly 108 with respect to the blade 106 shown in FIG. 3 is a representation of one embodiment and is not intended to imply that this is the only angle or a preferred angle at which the cutting element could be fixed into the blade 106.

The cutting element assembly 108 may include a journal 109 secured to the blade 106. For example, the journal 109 may be brazed or welded within a pocket of the blade 106. In other embodiments, for example, in the case of steel-body bits, the journal 109 may be integrally formed with the blade 106, such that there is no physical interface between the journal 109 and the blade 106.

As shown in FIG. 3, the journal 109 may have a frustoconical bearing surface 113 intersecting an upper cylindrical exterior surface 125. The upper cylindrical exterior surface 125 may intersect a top planar surface 123. The journal 109 may have an external groove 107, which may be, for example, cylindrical, channel sized, and configured to receive an O-ring, a split ring, a beveled retaining ring, a bowed retaining ring, a spiral retaining ring, a Belleville spring, or another retention element 115.

The cutting element assembly 108 may also include a rotatable cutting element 117. The rotatable cutting element 117 may include a table of polycrystalline hard material 105 bonded to a substrate 132 at an interface 133 or may have another material in addition to the polycrystalline hard material 105 and the substrate 132. The polycrystalline hard material 105 may include diamond, cubic boron nitride, or another hard material. The substrate 132 may include, for example, cobalt-cemented tungsten carbide or another carbide material.

The table of polycrystalline hard material 105 may have an end cutting surface 124, and may also have other surfaces, such as a side surface member, a chamfer 136, etc., at a peripheral cutting edge of the table of polycrystalline hard material 105, which surfaces contact a subterranean formation when the cutting element assembly 108 is used to form or service a wellbore. The table of polycrystalline hard material 105 may be generally cylindrical, and the interface 133 may be generally parallel to the end cutting surface 124.

The rotatable cutting element 117 may be rotatably coupled to the journal 109 with a retention element 115 within the external groove 107 of the journal 109 and the groove 121 of the substrate 132. For example, the groove 121 in the substrate 132 may have a radial width approximately equal to a radial width of the external groove 107 in the journal 109.

Certain interior surfaces of the rotatable cutting element 117 may substantially conform to the exterior surfaces of the journal 109, with an upper cylindrical interior surface 125 having an interior planar end surface 134 and intersecting a bearing surface which may be a frustoconical bearing surface 135, the bearing surface 104 (shown in FIG. 6), or some other surface. The interior surfaces of the rotatable cutting element 117 may generally define a blind hole 131 (shown in FIG. 6), into which the journal 109 may fit such that when the rotatable cutting element 117 rotates on the journal 109, the bearing surface 135 of the substrate 132 is in sliding contact with the frustoconical bearing surface 113 of the journal 109.

One or more of the bearing surfaces 135, 113 may be coated with a diamond-like coating, a coating similar to a diamond-like coating, or a lubricant. The coating or lubricant may be applied before drilling, may be applied during drilling, or may be applied both before and during drilling. Diamond-like coatings are described in, for example, U.S. Patent Application Publication 2009/0321146, "Earth Boring Bit with DLC Coated Bearing and Seal," published Dec. 31, 2009, the entire disclosure of which is hereby incorporated herein by reference.

The retention element 115 may be, for example, an O-ring, a split ring, a beveled retaining ring, a bowed retaining ring, a spiral retaining ring, a Belleville spring, or another retaining element. The retention element 115 may include a resilient material, and may be configured to spring into place, such that the rotatable cutting element 117 can be pressed onto the journal 109 without deforming either the journal 109 or the rotatable cutting element 117. For example, if the retention element 115 is an O-ring, the rotatable cutting element 117 may be attached onto the journal 109 by compressing the O-ring into the external groove 107 in the journal 109. Once the rotatable cutting element 117 slides into position (e.g., a position in which the bearing surface 135 of the substrate 132 contacts the frustoconical bearing surface 113 of the journal 109), the groove 121 in the substrate 132 may align with the external groove 107 of the journal 109. At that point, the O-ring may decompress, such that the rotatable cutting element 117 cannot be removed from the journal 109 without compressing the O-ring again. Thus, the O-ring may provide sufficient force to retain the rotatable cutting element 117 on the journal 109 under normal operating conditions, but the rotatable cutting element 117 may still be removed from the journal 109, if necessary, for repair.

The substrate 132 may have an interior planar end surface 134 perpendicular to an axis of rotation of the generally cylindrical portion of the substrate 132. In some embodiments, the interior planar end surface 134 of the substrate 132 may be substantially parallel to the end cutting surface 124 of the table of polycrystalline hard material 105 and/or to the interface 133 between the table of polycrystalline hard material 105 and the substrate 132.

The interior planar end surface 134 of the substrate 132 defining the interior planar end 109 may together partially define a void between the substrate 132 and the top planar surface 123 of the journal 109. This void may prevent compressive longitudinal loads (or longitudinal components of loads) on the rotatable cutting element 117 from being transferred to the journal 109 through the interior planar end surface 134 of the substrate 132 (e.g., because there may not be contact between the top planar surface 123 of the journal 109 and the interior planar end surface 134 of the substrate 132). Instead, compressive longitudinal loads may be transferred substantially (e.g., entirely or almost entirely) via a bearing interface at which the bearing surface 135 of the substrate 132 contacts the frustoconical bearing surface 113 of the journal 109.

Figure 4:
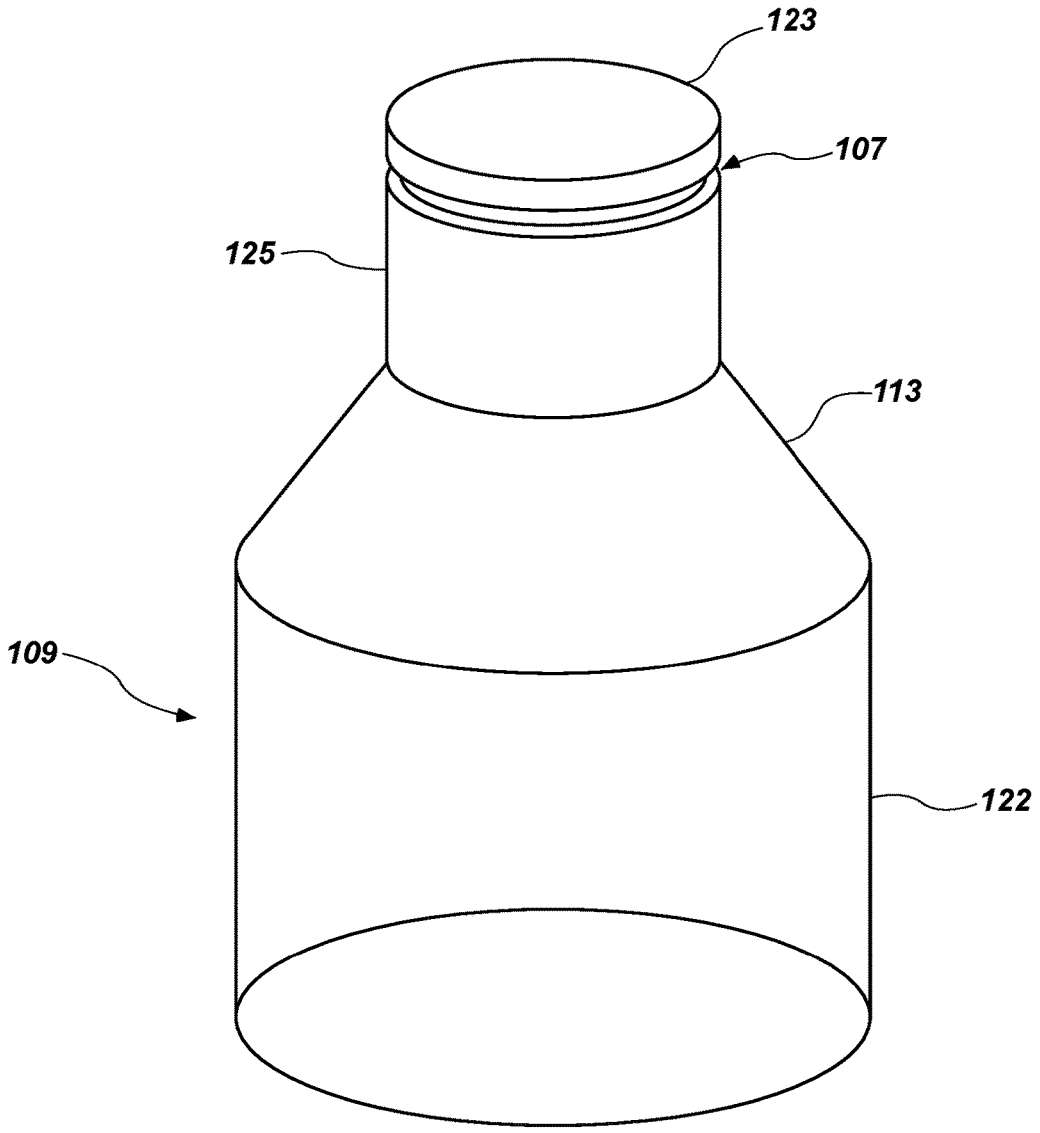
FIGS. 4 and 5 are simplified perspective views of two embodiments of journals as shown in FIG. 3.

FIG. 4 shows a simplified perspective view of one embodiment of the journal 109. A lower portion 122 of the journal 109, which may be cylindrical or any other shape, may be fully or partially inserted into the blade 106 (shown in FIG. 3). Proceeding up from the lower portion 122 of the journal 109, is the bearing surface, which as shown in this embodiment may be a frustoconical bearing surface 113. Rising from the frustoconical bearing surface 113, is an upper cylindrical exterior surface 125 that may have an external groove 107 near the top planar surface 123. The top planar surface 123, the upper cylindrical exterior surface 125, and the frustoconical bearing surface 113 may have generally corresponding shapes to interior surfaces of the rotatable cutting element 117 (shown in FIG. 3) defining the blind hole 131 (shown in FIG. 6).

Figure 5:
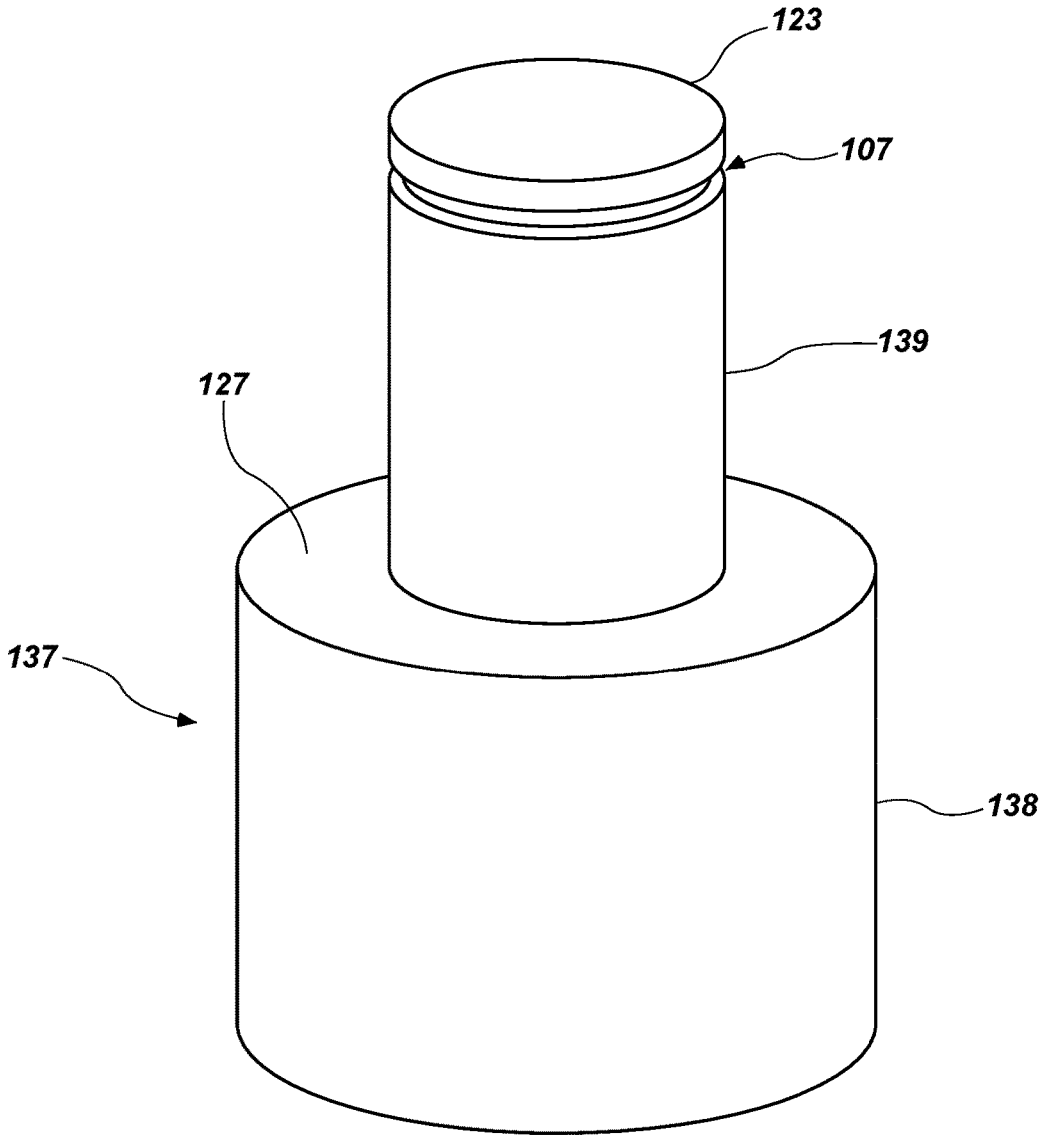

FIG. 5 shows a simplified perspective view of another embodiment of a journal 137. A lower portion 138 of a journal 137, which may be cylindrical or any other shape, may be fully or partially inserted into the blade 106 (shown in FIG. 3). A bearing surface 127, which as shown in this embodiment may be an annular plane transverse to a longitudinal axis of journal 137, marks the transition from the lower portion 138 of the journal 137 to an upper cylindrical exterior surface 139 of the journal 137. The upper cylindrical exterior surface 139 may have an external groove 107 near the top planar surface 123. The top planar surface 123 and the upper cylindrical exterior surface 139 may have generally corresponding shapes to interior surfaces of the rotatable cutting element 143 (shown in FIG. 6) defining the blind hole 131 (shown in FIG. 6).

Figure 6:
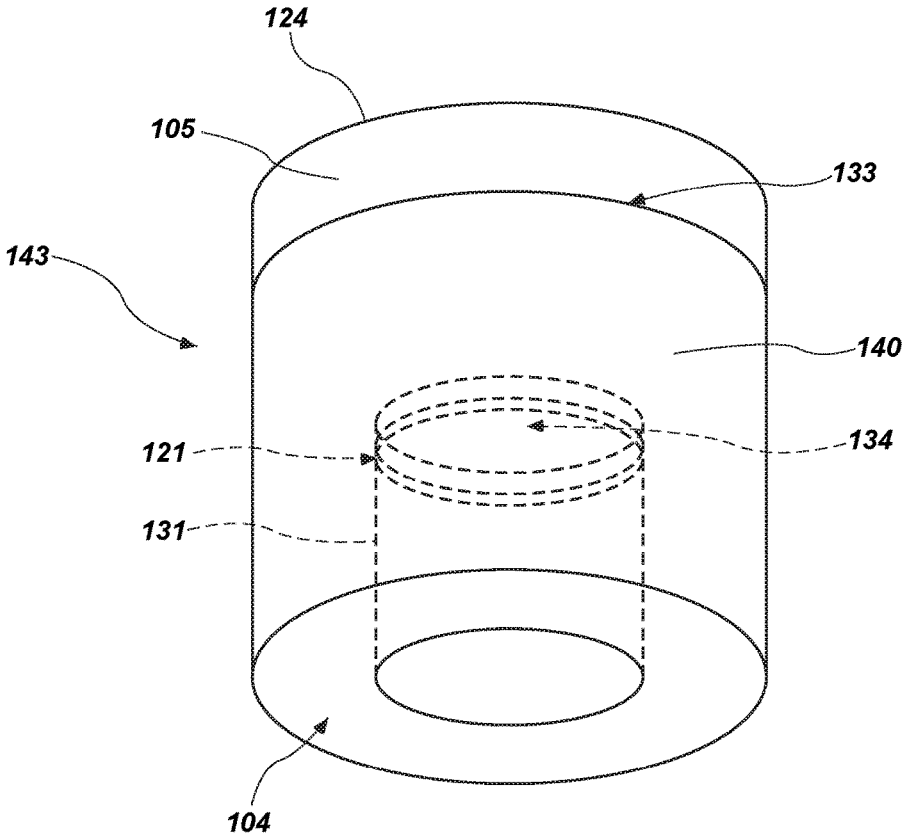
FIG. 6 is a simplified perspective view of one embodiment of a rotatable cutting element that may be used in conjunction with a journal, such as the one shown in FIG. 5.

FIG. 6 shows a simplified perspective view of one embodiment of a rotatable cutting element 143. The rotatable cutting element 143 may include a table of polycrystalline hard material 105 bonded to a substrate 140 at an interface 133. In this embodiment, the bearing surface 104 may be planar and annular. The interior surfaces of the substrate 140 of the rotatable cutting element 143 may generally define a longitudinally extending blind hole 131, with a groove 121 in the surface of the substrate 140 that defines the blind hole 131 near an interior planar end surface 134 of the blind hole 131. A journal, configured as journal 137 (shown in FIG. 5), may fit into the blind hole 131 such that when the rotatable cutting element 143 rotates on the journal 137 (shown in FIG. 5), the bearing surface 104 of the substrate 140 is in sliding contact with the bearing surface 127 of the journal 137 (Shown in FIG. 5). The compressive force from the rotatable cutting element 143 may be transferred to the journal 137 (shown in FIG. 5) via the bearing surface 104 of the substrate 140 and the bearing surface 127 of the journal 137 (shown in FIG. 5).

Rotatable cutting element assemblies as disclosed herein may have certain advantages over conventional rotatable cutting elements and over conventional fixed cutting elements. For example, journals may be installed into a bit body (e.g., by brazing) or integrally formed with the bit body or a blade thereof before the rotatable cutting elements are installed onto the journals. Thus, the rotatable cutting elements, and particularly the PDC tables, need not be exposed to the high temperatures typical of brazing. Thus, installing rotatable cutting elements onto journals already secured to a bit body may avoid thermal damage caused by brazing.

Furthermore, rotatable cutting elements as disclosed herein may be removed and replaced more easily, such as when the cutting elements are worn or damaged. Separation of rotatable cutting element from a journal secured by retention elements may be trivial in comparison to removal of cutting elements or journals brazed into a bit body. For example, rotatable cutting elements may be removed by applying tension (i.e., a pulling force) to the cutting elements. Similarly, insertion of a new cutting element may be effected rapidly and without reheating of the drill bit. Thus, drill bits may be repaired more quickly than drill bits having conventional cutting elements.

Additional non-limiting example embodiments of the disclosure are described below.

Embodiment 1: A cutting element assembly comprising a journal, a rotatable cutting element, and a retention element. The journal defines an upper cylindrical exterior surface and a first bearing surface, wherein the upper cylindrical exterior surface intersects the first bearing surface. The journal further defines a first external annular groove in the upper cylindrical exterior surface. The rotatable cutting element comprises a table of polycrystalline hard material having an end cutting surface and a supporting substrate. The substrate defines a second bearing surface, a longitudinally extending blind hole having a diameter larger than a diameter of the upper cylindrical exterior surface of the journal, and a second groove in a surface of the substrate defining the blind hole. The retention element is disposed at least partially in the first groove and partially within the second groove.

Embodiment 2: The cutting element assembly of Embodiment 1, wherein the blind hole of the rotatable cutting element defines an interior back surface parallel to the end cutting surface, and wherein the journal and the rotatable cutting element together define a void adjacent the interior back surface.

Embodiment 3: The cutting element assembly of Embodiment 1 or Embodiment 2, wherein each of the first bearing surface and the second bearing surface exhibit a frustoconical shape.

Embodiment 4: The cutting element assembly of Embodiment 1 or Embodiment 2, wherein each of the first bearing surface and the second bearing surface comprise a planar annular surface.

Embodiment 5: The cutting element assembly of any of Embodiments 1 through 4, wherein the bearing surface of the rotatable cutting element and the bearing surface of the journal are in rotational sliding contact.

Embodiment 6: The cutting element assembly of any of Embodiments 1 through 5, wherein the bearing surface of the rotatable cutter and the bearing surface of the journal are coated with a protective coating such as a diamond-like coating.

Embodiment 7: The cutting element assembly of any of Embodiments 1 through 6, wherein the bearing surface of the rotatable cutter and the bearing surface of the journal are coated with a lubricant.

Embodiment 8: The cutting element assembly of any of Embodiments 1 through 7, wherein the retention element comprises an elastomeric material.

Embodiment 9: The cutting element assembly of any of Embodiments 1 through 7, wherein the retention element comprises a metal.

Embodiment 10: The cutting element assembly of any of Embodiments 1 through 9, wherein the retention element comprises at least one selected from the group consisting of an O-ring, a split ring, a beveled retaining ring, a bowed retaining ring, a spiral retaining ring, and a Belleville spring.

Embodiment 11: The cutting element assembly of any of Embodiments 1 through 10, wherein the journal is brazed into a blade of an earth-boring tool.

Embodiment 12: The cutting element assembly of any of Embodiments 1 through 11, wherein the difference between the diameter of the blind hole and the diameter of the upper cylindrical exterior surface of the journal is between about 0.001 inch and about 0.002 inch.

Embodiment 13: The cutting element assembly of any of Embodiments 1 through 12, wherein the second bearing surface is outside the blind hole.

Embodiment 14: An earth-boring tool comprising a bit body comprising at least one blade, a journal, a rotatable cutting element, and a retention element. The earth-boring tool body comprises at least one blade extending radially outward defining a face proximate a leading end of the body. The journal is carried by a rotationally leading portion of the blade and defines an upper cylindrical exterior surface and a first bearing surface, wherein the upper cylindrical exterior surface intersects the first bearing surface. The journal further defines a first external annular groove in the upper cylindrical exterior surface. The rotatable cutting element comprises a table of polycrystalline hard material, has an end cutting surface and a supporting substrate. The substrate defines a second bearing surface, a longitudinally extending blind hole having a diameter larger than a diameter of the upper cylindrical exterior surface of the journal, and a second groove in the surface of the substrate surface defining the blind hole. The retention element is disposed at least partially in the first groove and partially within the second groove.

Embodiment 15: The earth-boring tool of Embodiment 14, wherein the rotatable cutting element defines an interior back surface parallel to the end cutting surface, and wherein the journal and the rotatable cutting element define a void adjacent the interior back surface.

Embodiment 16: The earth-boring tool of Embodiment 14 or Embodiment 15, wherein each of the first bearing surface and the second bearing surface exhibit a frustoconical shape.

Embodiment 17: The earth-boring tool of Embodiment 14 or Embodiment 15, wherein each of the first bearing surface and the second bearing surface comprise a planar annular surface.

Embodiment 18: The earth-boring tool of any of Embodiments 14 through 17, wherein the first bearing surface of the journal is in rotational sliding contact with the second bearing surface of the rotatable cutting element.

Embodiment 19: The earth-boring tool of any of Embodiments 14 through 18, wherein at least one surface selected from the group consisting of the first bearing surface and the second bearing surface is coated with a diamond-like carbon.

Embodiment 20: The earth-boring tool of any of Embodiments 14 through 19, further comprising a lubricant between the first bearing surface and the second bearing surface.

Embodiment 21: The earth-boring tool of any of Embodiments 14 through 20, wherein the retention element comprises an elastomeric material.

Embodiment 22: The earth-boring tool of any of Embodiments 14 through 20, wherein the retention element comprises a metal.

Embodiment 23: The earth-boring tool of any of Embodiments 14 through 22, wherein the retention element comprises at least one selected from the group consisting of an O-ring, a split ring, a beveled retaining ring, a bowed retaining ring, a spiral retaining ring, and a Belleville spring.

Embodiment 24: The earth-boring tool of any of Embodiments 14 through 23, wherein the journal is brazed into a blade of the earth-boring tool.

Embodiment 25: The earth-boring tool of any of Embodiments 14 through 24, wherein a difference between the diameter of the blind hole and the diameter of the upper cylindrical exterior surface of the journal is between about 0.001 inch and about 0.002 inch.

Embodiment 26: The earth-boring tool of any of Embodiments 14 through 25, wherein the second bearing surface is outside the blind hole.

Embodiment 27: The earth-boring tool of any of Embodiments 14 through 26, wherein the journal is integral with at least one blade.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors. Further, embodiments of the disclosure have utility with different and various types and configurations of earth-boring tools.

What is claimed is:

1. A cutting element assembly comprising:

an inner journal defining an upper cylindrical exterior surface, a planar top surface, and a first bearing surface located below the upper cylindrical exterior surface, wherein the upper cylindrical exterior surface intersects the first bearing surface, and wherein the inner journal further defines a first external annular groove in the upper cylindrical exterior surface;

an outer rotatable cutting element mounted on and rotatable around the inner journal, the outer rotatable cutting element comprising a table of polycrystalline hard material having an end cutting surface and a supporting substrate, the substrate defining a second bearing surface in sliding rotational contact with the first bearing surface of the inner journal, each of the first bearing surface and the second bearing surface having a frustoconical shape, a longitudinally extending blind hole having a diameter larger than a diameter of the upper cylindrical exterior surface of the inner journal, and a second groove in a surface of the substrate surface defining the blind hole; and a retention element disposed at least partially in the first groove and partially within the second groove.

2. The cutting element assembly of claim 1, wherein the blind hole of the outer rotatable cutting element defines an interior back surface parallel to the end cutting surface, and wherein the inner journal and the outer rotatable cutting element together define a void adjacent the interior back surface.

3. The cutting element assembly of claim 1, wherein at least one surface selected from the group consisting of the first bearing surface and the second bearing surface is coated with diamond-like carbon.

4. The cutting element assembly of claim 1, further comprising a lubricant between the first bearing surface and the second bearing surface.

5. The cutting element assembly of claim 1, wherein the retention element comprises an elastomeric material.

6. The cutting element assembly of claim 1, wherein the retention element comprises a metal.

7. The cutting element assembly of claim 1, wherein the retention element comprises at least one retention element selected from the group consisting of an O-ring, a split ring, a beveled retaining ring, a bowed retaining ring, a spiral retaining ring, and a Belleville spring.

8. The cutting element assembly of claim 1, wherein a difference between a diameter of the blind hole and a diameter of the upper cylindrical exterior surface of the inner journal is between about 0.001 inch and about 0.002 inch.

9. The cutting element assembly of claim 1, wherein the second bearing surface is outside the blind hole.

10. An earth-boring tool comprising:

a body comprising at least one blade extending radially outward to define a face proximate a leading end of the body;

an inner journal carried by a rotationally leading portion of the at least one blade and defining an upper cylindrical exterior surface, a planar top surface a first bearing surface located below the upper cylindrical exterior surface, wherein the upper cylindrical exterior surface intersects the first bearing surface, and wherein the inner journal further defines a first external annular groove in the upper cylindrical exterior surface;

an outer rotatable cutting element mounted on and rotatable around the inner journal, the outer rotatable cutting element comprising a table of polycrystalline hard material having an end cutting surface and a supporting substrate, the substrate defining a second bearing surface in sliding rotational contact with the first bearing surface of the inner journal, each of the first bearing surface and the second bearing surface having a frustoconical shape, a longitudinally extending blind hole having a diameter larger than a diameter of the upper cylindrical exterior surface of the inner journal, and a second groove in a surface of the substrate surface defining the blind hole; and a retention element disposed at least partially in the first groove and partially within the second groove.

11. The earth-boring tool of claim 10, wherein at least one surface selected from the group consisting of the first bearing surface and the second bearing surface is coated with a diamond-like carbon.

12. The earth-boring tool of claim 10, wherein the inner journal is brazed into a blade of the earth-boring tool.

13. The earth-boring tool of claim 10, wherein the second bearing surface is outside the blind hole.

14. The earth-boring tool of claim 10, wherein the inner journal is integral with at least one blade.

* * * * *